United States Patent [19]

Brunette

[11] 4,150,762

[45] Apr. 24, 1979

[54] MERCHANDISING BIN

[75] Inventor: Frederick F. Brunette, Farmington, Mich.

[73] Assignee: Brilliant Products, Inc., Plymouth, Mich.

[21] Appl. No.: 788,320

[22] Filed: Apr. 18, 1977

Related U.S. Application Data

[63] Continuation-in-part of Ser. No. 645,898, Dec. 31, 1975, Pat. No. 4,053,955.

[51] Int. Cl.[2] ..... B65D 7/20; B65D 7/24; B65D 21/02

[52] U.S. Cl. ..... 220/19; 206/513; 220/6

[58] Field of Search ..... 206/513; 220/1.5, 6, 220/19, 331, 334

[56] References Cited

U.S. PATENT DOCUMENTS

| | | | |
|---|---|---|---|
| 2,632,578 | 3/1953 | Brickman | 220/6 |
| 3,372,829 | 3/1968 | Averill | 220/19 X |
| 4,015,743 | 4/1977 | Beretta | 220/19 |
| 4,023,698 | 5/1977 | Joseph | 220/19 X |

*Primary Examiner*—William Price
*Assistant Examiner*—Steven M. Pollard
*Attorney, Agent, or Firm*—Gifford, Chandler, VanOphem, Sheridan & Sprinkle

[57] ABSTRACT

A collapsible bin is provided which is particularly suitable for displaying merchandise for sale. The bin comprises a base and a front wall, a back wall, and a pair of sidewall sections which are pivotally secured to the base and which are pivotal between a first and a second position. In the first position, the wall sections are generally perpendicular to the base so that the wall sections lie generally in a vertical plane. Locking members are provided along the vertical edges of adjacent wall sections to retain the wall sections in their first positions so that merchandise may be placed in the interior of the bin.

With the locking members unlocked, the wall sections can be pivoted to their second position. In the second position, each wall section lies generally in a horizontal plane, generally parallel to the plane of the base, so that the wall sections are stacked upon each other closely adjacent to the base.

6 Claims, 7 Drawing Figures

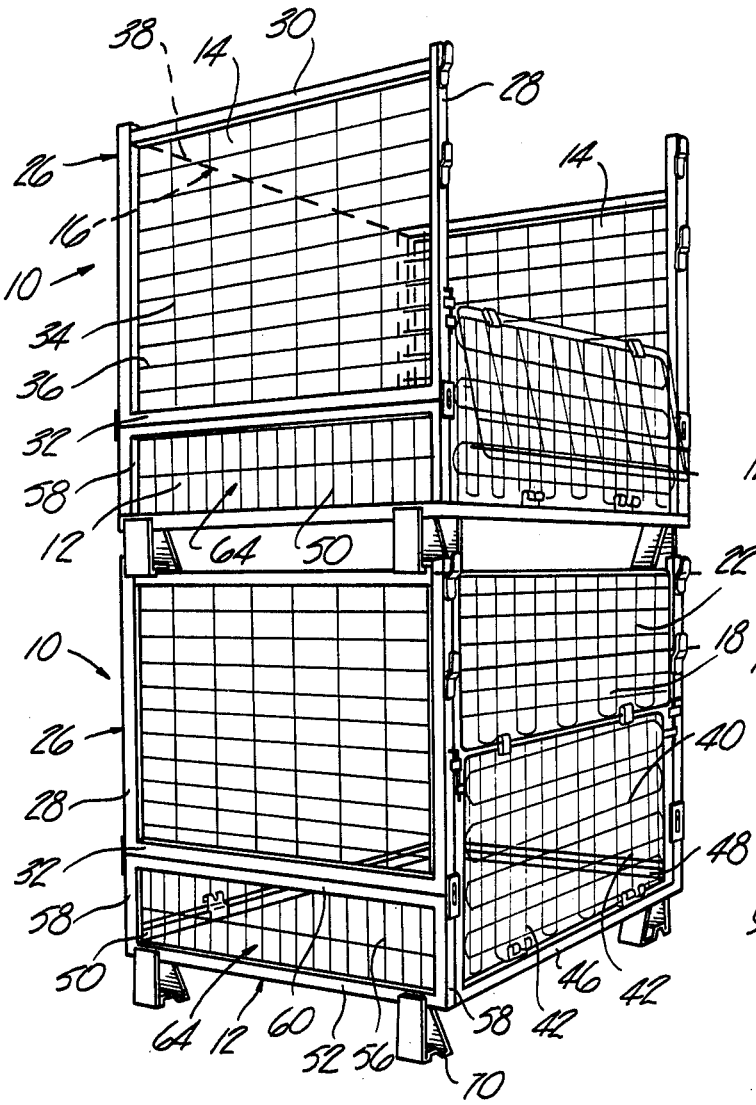
Fig-1
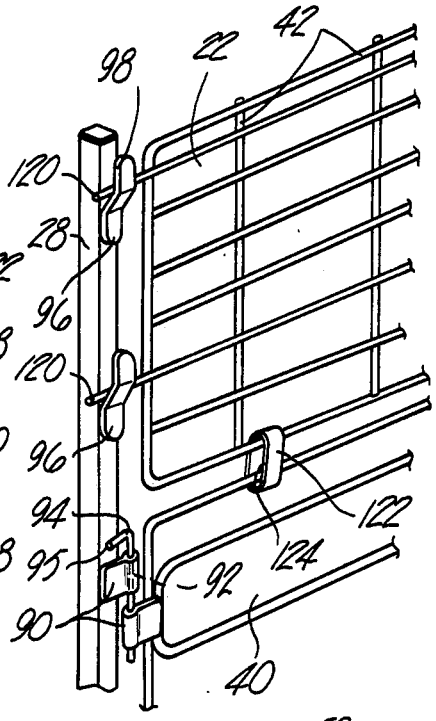
Fig-2
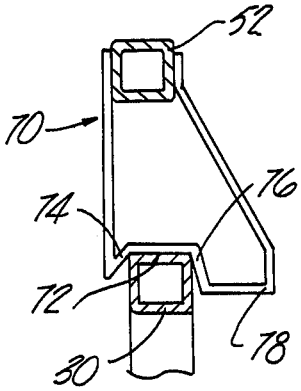
Fig-4
Fig-3
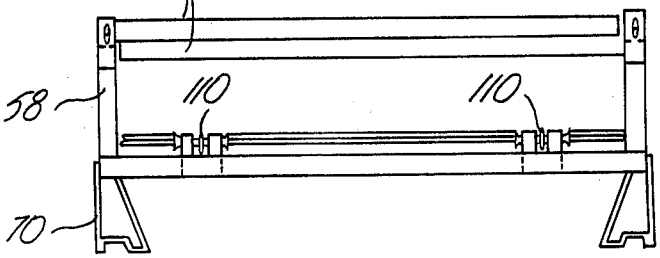

MERCHANDISING BIN

CROSS REFERENCE

The present application is a continuation in part of copending patent application Ser. No. 645,898, filed on Dec. 31, 1975, now U.S. Pat. No. 4,053,955.

BACKGROUND OF THE INVENTION

I. Field of the Invention

The present invention relates generally to containers and, more particularly, to a collapsible container particularly suited for displaying merchandise.

II. Description of the Prior Art

Bins for displaying merchandise, known in the trade as hypermarche bins, have long been used in European countries and are now enjoying increasing acceptance in the United States. Hypermarche bins are advantageous to retailers in that handling and display costs are reduced since relatively large amounts of merchandise can be dumped into the bins and then moved to the point of display. This reduces storage costs and eliminates the need for separately removing each item of merchandise from containers and arranging the merchandise items on a shelf. Moreover, hypermarche bins typically include provisions for stacking one bin upon another thereby maximizing the utilization of the available floor space. It is for these reasons that the use of hypermarche bins is becoming increasingly prevalent in the United States.

Since the hypermarche bin is designed to store and display relatively large amounts of merchandise, the previously known bins are, of necessity, bulky in nature. Consequently, the storage of empty bins has rapidly developed into a major storage problem. In practice, the cost savings achieved by these bins is often times offset by the storage cost of empty bins.

Also heretofore such bins have been made entirely of wire members and therefore have not been sufficiently sturdy to support a number of filled bins one on top the other.

In order to reduce the storage costs of empty bins, previously known bins have been developed in which the bin is collapsible thereby reducing the space consumed by the empty bin. However, these previously known collapsible bins have proven, in practice, to be somewhat difficult to assemble by the merchandiser's employees. An improperly assembled bin is prone to collapse, which not only damages the merchandise, but also presents a serious safety hazard when the merchandising bins are stacked one upon the other. Furthermore, these previously known bins, even when collapsed, are nevertheless bulky and, accordingly, difficult to store.

SUMMARY OF THE PRESENT INVENTION

The merchandising bin of the present invention overcomes the disadvantages of the previously known bins by providing a strong collapsible bin which may be quickly, easily, and securely assembled.

The bin of the present invention comprises a front wall section, a back wall section, and two sidewall sections each of which is pivotally secured to a base and is movable between a first and a second position. In the first position, the wall sections are generally perpendicular to the base and locking members are provided along the vertical edges of adjacent wall sections to secure the wall sections together and to maintain the wall sections in their first or assembled position. An access panel on the front wall sections permits access to the interior of the bin.

With the locking members unlocked, the wall sections are movable into their second position in which each of the wall sections are stacked on each other on the base so that each wall section lies generally in a horizontal plane on top of each other on the base. In the second, or collapsed position, the volume consumed by the bin is substantially less than in its assembled condition so that less storage space is consumed.

Both of the sidewall sections include tubular frame members while the front and back wall sections are constructed of the conventional wire members. This construction not only provides a sturdy construction but also permits compact collapsibility of the bin.

BRIEF DESCRIPTION OF THE DRAWINGS

The merchandising bin of the present invention will be more clearly understood by reference to the following detailed description when read in conjunction with the accompanying drawing, wherein like reference characters refer to like parts throughout the several views, and in which:

FIG. 1 is a perspective view showing two merchandising bins of the present invention, one bin stacked upon the other;

FIG. 2 is a fragmentary perspective view showing the front wall section and also the locking members between adjacent wall sections;

FIG. 3 is a plan view showing the merchandising bin of the present invention in a collapsed condition;

FIG. 4 is a fragmentary cross-sectional view showing the foot provided for stacking the bins of the present invention;

DETAILED DESCRIPTION OF THE INVENTION

Figure 5:
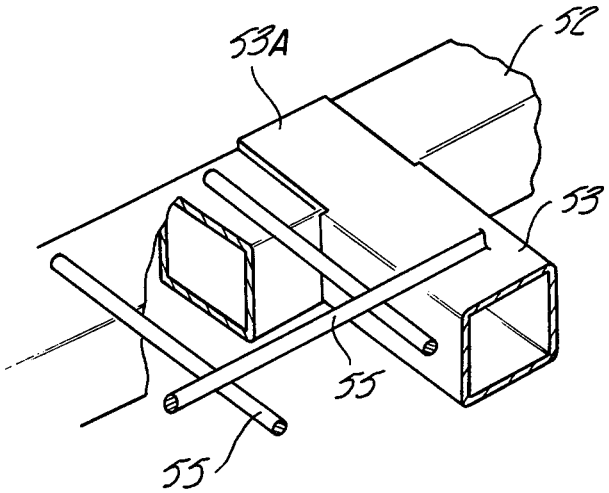
FIG. 5 is a fragmentary view with portions in section and other portions removed to illustrate the connection of the tubular support member on the base of the bin.

Referring now to FIG. 1, two merchandising bins 10 of the present invention are illustrated one stacked upon the other in a manner to be hereinafter described in detail. The bin 10 generally comprises a base 12, a pair of sidewall sections 14 mounted on opposite sides of the base 12, a back wall section 16, and a front wall section 18. p Each sidewall section 14 is provided with a rectangular frame 26 around its periphery. The frame 26 is preferably constructed of square tubular metal and further comprises a pair of spaced vertical posts 28 and upper and lower horizontal posts 30 and 32. A plurality of rigid vertical wire strands 34 are welded or otherwise secured between the horizontal frame members 30 and 32 while similar horizontal wire strands 36 are welded between the vertical frame members 28. Wire strands 36 are also preferably welded to wire strands 34 so that the sidewall section 14 enjoys a generally rigid construction.

The back wall section 16, unlike the sidewall section 14, is constructed of crisscrossing horizontal and vertical wire members 38. The wire members 38 are secured together by welding at each intersection so that the back wall section 16 is rigidly constructed.

Referring to FIGS. 1 and 2, the front wall section 18 is similar to the back wall section 16 and comprises a lower horizontal wall portion 40 and an upper access panel 22. The wall portions 40 and panel 22 are secured together in a manner hereinafter described in detail and both the wall portion 40 and panel 22 are constructed of crossing horizontal and vertical wire members 42. The wire members 42 are welded or otherwise secured together at each intersection so that the wall portion 40 and panel 22 enjoy a rigid construction.

Four square tubular frame members 46, 48, 50, and 52 and cross members 53 (FIG. 5) form the bottom of the base 12 in a generally horizontal plane so that frame members 46 and 50 are in a generally spaced and parallel relationship while, similarly, frame members 48 and 52 are in a spaced and parallel relationship. The cross members 53 are parallel to the frame members 46 and 50 and preferably are supported by the members 42 and 52 in the manner illustrated in FIG. 5.

As shown in FIG. 5, the cross members 53 have a portion of each end removed to leave an upper portion 53A which extends over the upper surface of the members 48 and 52 and is affixed thereto by welding (not shown) or other suitable means. Wire members 55 extend in crisscross fashion above the frame members 48, 46, 50, 52, and 53.

Referring to FIG. 1, a vertical post 58 extends vertically upwardly from each end of the frame members 48 and 52 and a pair of horizontal frame members 60 are secured across the upper end of the posts 58 so that one frame member 60 is generally parallel to the bottom frame member 52 while the other frame member 60 is generally parallel to the frame member 48. Rigid wire strands 56 extend upwardly from the frame members 48 and 52 and are secured to the corresponding frame members 60 thus forming a pair of vertically spaced and parallel side panels 64.

In order to permit one bin 10 to be stacked upon another bin 10, a pair of feet 70, best shown in FIGS. 1, 3, and 4, are secured to each of the side frame members 52 and 48 of the base 12. The foot 70 may take any of several forms, but preferably, each is constructed or secured by welding to the appropriate frame members 52 or 48. A rectangular channel 72 faces downwardly and is dimensioned to receive the upper horizontal frame member 30 of the side panel 14. The formation of the rectangular channel 72 is preferred in that the sides 74 and 76 of the channel 72 overlap the frame member 30 to prohibit lateral movement of the foot 70 relative to the frame member 30 thus ensuring the stability of the bins 10 when stacked. Additionally, each foot is provided with a horizontal portion 78 adapted to abut the ground or supporting surface for the lowermost bin.

Each of the sidewall sections 14 is pivotally connected between the vertical posts 28 to the base 12 and is movable between a first, or vertical, position and a second, or horizontal, position. Each pivotal connection between each sidewall vertical post 28 and the corresponding vertical post 58 on the side panel 64 is substantially the same so that for the sake of brevity, only the left front pivotal connection will be described in detail.

Figure 6:
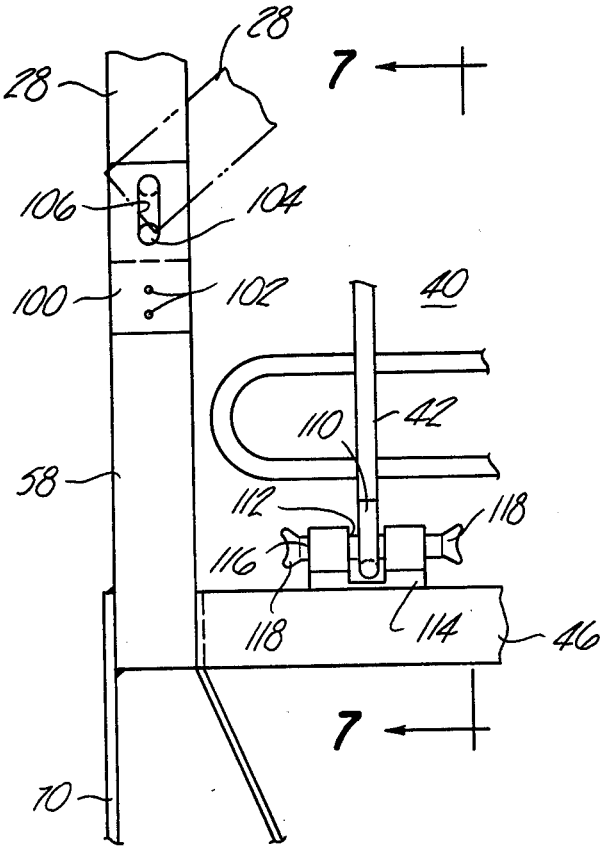
FIG. 6 is a fragmentary plan view showing the hinge on one side wall section and enlarged for clarity.
Figure 7:
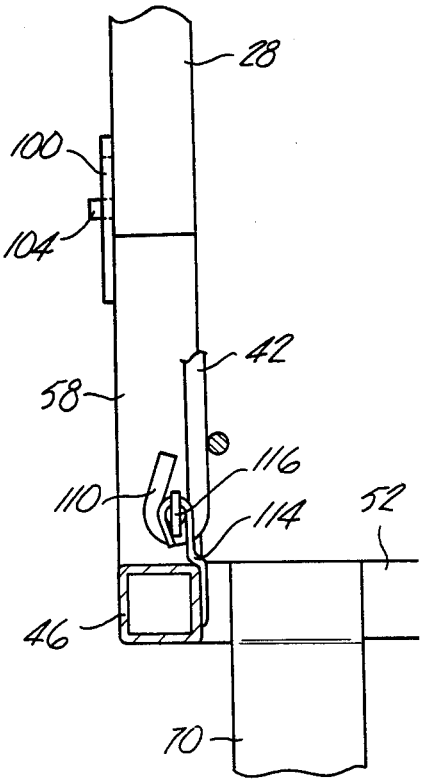
FIG. 7 is a fragmentary partial sectional view taken substantially along line 7—7 in FIG. 6.

With reference now to FIGS. 6 and 7, the sidewall vertical post 28 is thereshown coaxially positioned on top of the side panel post 58. A flat plate 100 is attached by spot welds 102 to the front side of the side panel post 58 so that the upper portion of the plate 100 extends across the front side of the sidewall post 28. A forwardly projecting pin 104 is secured to the post 28 and extends through a vertically elongated slot 106 in the plate 100. With the posts 28 and 58 vertically aligned, the lower end of the upper post 28 flatly abuts against the upper end of the lower post 58 which maintains the vertical position of the side panel 14 due to its weight.

If it is desired to collapse the bin 10 to the position illustrated in FIG. 3, the sidewall 14 is lifted upwardly from the side panel 64 thus separating the posts 28 and 58 from each other and moving the pin 104 upwardly in the slot 106. In this position the sidewall 14 can be pivoted inwardly, as shown in phantom line, due to the separation of the posts 28 and 58.

Similarly, both the back wall section 18 and the lower wall portion 40 of the front wall section 18 are pivotally mounted to the frame members 50 and 46, respectively, of the base 12 and movable between a first, or vertical, position and a second, or horizontal, position. Both the front and back wall sections 16 and 18 are pivotally connected to the base in substantially the same fashion so that for brevity only the pivotal connection between the lower wall portion 40 of the front wall section 16 and the frame member 46 will be described in detail.

With reference now to FIGS. 1, 6, and 7, at least two spaced vertical wire members 42 on the front wall section 16 extend downwardly and are formed into a loop 110 at their lowermost end. Each loop 110 in turn is received in a slot 112 in a bracket 114 secured to the frame member 46. The cross sectional shape of the slot 112 is tubular so that the loop 110 is retained within the slot 112 by inserting a pin 116 through the tubular portion of the bracket 114 and the loop 110. Preferably the pin 116 is crimped at each outwardly extended end 118 in order to retain the pin 116 to the bracket 114.

When it is desired to collapse the bin 10 to the configuration shown in FIG. 3, the front and back wall sections 18 and 16 are first folded inwardly to the interior of the bin 10. Since the wire members forming these wall sections are of a relatively small diameter, the front and back wall sections 18 and 16 lie flatly, one on top of the other. Thereafter the sidewall sections 14 are pivoted inwardly in the above-described fashion and lie relatively flat on top of one another and the front and back wall sections 18 and 16.

Appropriate means are, of course, necessary to secure the wall sections together when the wall sections are in their first or vertical positions to prevent unintended collapse of the wall sections. One such means is illustrated in FIG. 2 as comprising a first bracket 90 secured by welding to the vertical post 28 of the sidewall section and a like bracket 90 secured to one wire member 42 of the front wall lower wall portion 40 so that one bracket 90 is vertically spaced from the other bracket 90. Each bracket 90 includes a channel 92 which is in registration with the other channel 92 when the adjacent wall sections are in their first position. A pin 94 is provided and is adapted to be received through the channels 92 to lock the wall sections together in their first position. Appropriate stop means 95 are provided on the pin 94 to prohibit the pin 94 from dropping unintentionally through the channel portions 92. Similar locking means secure a wire member on the back wall section 16 to the rear vertical posts 28 of the sidewall sections 14.

The connection between the access panel 22 and the sidewall section 14 is best illustrated in FIG. 2 and comprises a plurality of latch members 96 secured to the vertical post 28 to form an upwardly facing U-shaped opening 98 between the latch member 96 and the post 28. The access panel 22 includes a plurality of rigid wire strand members 120 extending horizontally outwardly from the panel 22 which are adapted to be received in the U-shaped opening 98 to secure the panel 22 to the vertical post 28.

Additionally, the access panel 22 is secured to the lower wall portion 40 by a metal band 122 having an elongated slot 124 formed therein. The band 122 is secured around wire strands on the panel 22 and the wall portion 40 and permits limited vertical movement between them so that the access panel 22 can be opened without adjustment of the lower wall portion 40. The band 122 also prevents separation of the panel 22 from the wall portion 40.

It can thus be seen that the merchandising bin 10 of the present invention provides substantial advantages over the previously known bins by providing a collapsible bin that is not only easily but also quickly assembled and disassembled. Moreover, by providing tubular framing members only on the sidewall sections, the overall cost of the bin of the present invention is greatly reduced with little or no sacrifice in the overall ruggedness of the bin. Additionally, the provision of framing members on only the sidewall sections provides the compact collapsed bin, shown in FIG. 3, for easy storage of the bin.

Still further cost savings are achieved by the inexpensive pivotal connections between the wall sections and the base. These inexpensive hinges can be used with sacrifice of the overall rigidity of the bin since the rigidity of the frame is maintained by the interlocked wall sections.

Having described my invention, many modifications thereto will become apparent to those skilled in the art to which it pertains without deviation from the spirit of the invention as defined by the scope of the appended claims.

What is claimed is:

1. A collapsible bin comprising:

a base;

first and second sidewalls pivotally mounted to opposed sides of said base and movable between a first and second position, each of and only said sidewalls having tubular framing members about its periphery and criss-crossing wire members secured to and between said framing members, wherein in said first position said sidewalls are generally perpendicular to the plane of said base and generally in a spaced apart and parallel relationship relative to each other and wherein in said second position said sidewalls are generally parallel to the plane of said base;

a back wall constructed of criss-crossing wire members and pivotally secured to the back side of said base, said back wall being movable between a first position generally perpendicular to said base and a second position generally parallel to said base;

a front wall constructed of criss-crossing wire members and pivotally secured to the front side of said base, said front wall being pivotally mounted to said base between a first position generally perpendicular to the plane of said base and a second position generally parallel to the plane of said base;

wherein with said walls in a first position at least one wire member on said front and back walls is adjacent to a framing member on each of said sidewalls;

means for locking the adjacent wire members on said front wall and said back wall to the corresponding framing member on said sidewalls when said front wall, back wall, and sidewalls are in said first position; and at least one foot secured to the underside of said base along the two opposing sidewalls thereof, wherein said feet are adapted to engage the upper edge of the upper sidewall framing member of a second and lower bin so that said former bin may be stacked upon the similarly formed lower bin whereby substantially the entire weight of said former bin is supported by the tubular sidewall framing members of said lower bin.

2. The invention as defined in claim 1 wherein the upper portion of said front wall comprises an access panel removably secured to one framing member on each sidewall for permitting access into said bin.

3. The bin as defined in claim 2 and including at least one band for attaching said access panel to said front wall.

4. The bin as defined in claim 1 and further comprising at least one foot secured to the underside of said base along two opposing sides thereof, wherein said feet are adapted to engage the upper edge of the upper sidewall framing member of a second bin so that said bin may be stacked upon a similarly formed bin.

5. The bin as defined in claim 1 in which said locking means further comprises a pair of locking members disposed between each pair of adjacent walls, wherein one locking member is secured to the sidewall framing member and the other locking member is secured to one wire member on the other adjacent wall, said locking members including registering apertures when said walls are in said first position, and a locking pin adapted to be received in said registering apertures.

6. The bin as defined in claim 1 wherein said base includes framing members about its periphery and wherein at least two vertical wire members on each of said front and back walls include a loop at their lowermost end, said bin including at least two brackets secured to said base framing members, and means for pivotally securing said loops to said brackets.

* * * * *

UNITED STATES PATENT AND TRADEMARK OFFICE

CERTIFICATE OF CORRECTION

PATENT NO. : 4,150,762

DATED : April 24, 1979

INVENTOR(S) : Frederick F. Brunette

It is certified that error appears in the above—identified patent and that said Letters Patent is hereby corrected as shown below:

IN RELATED UNITED STATES APPLICATION DATA:

Please delete "Pat. No. 4,053,955" and insert --now abandoned--.

Signed and Sealed this

*Seventh* Day of *August 1984*

[SEAL]

*Attest:*

GERALD J. MOSSINGHOFF

*Attesting Officer*

*Commissioner of Patents and Trademarks*